US011655626B2

(12) United States Patent
Meyers et al.

(10) Patent No.: US 11,655,626 B2
(45) Date of Patent: May 23, 2023

(54) PLASTIC COMPONENTS FOR INSTALLATION IN TILED WET ENVIRONMENTS

(71) Applicant: EBBE AMERICA, LC, Clearfield, UT (US)

(72) Inventors: Lawrence G. Meyers, Clearfield, UT (US); Alden S. Meyers, Clearfield, UT (US)

(73) Assignee: EBBE AMERICA, LC, Clearfield, UT (US)

( * ) Notice: Subject to any disclaimer, the term of this patent is extended or adjusted under 35 U.S.C. 154(b) by 122 days.

(21) Appl. No.: 17/210,182

(22) Filed: Mar. 23, 2021

(65) Prior Publication Data

US 2021/0301518 A1 Sep. 30, 2021

Related U.S. Application Data

(60) Provisional application No. 62/993,808, filed on Mar. 24, 2020.

(51) Int. Cl.
*E03F 5/04* (2006.01)
*A47K 3/40* (2006.01)

(52) U.S. Cl.
CPC ..... *E03F 5/0408* (2013.01); *A47K 3/40* (2013.01)

(58) Field of Classification Search
CPC ..... E03F 5/0408; E03F 5/0407; A47K 3/40
USPC ..... 4/612
See application file for complete search history.

(56) References Cited

U.S. PATENT DOCUMENTS

| | | | | |
|---|---|---|---|---|
| 3,761,965 | A | 10/1973 | Barasch et al. | |
| 5,216,767 | A * | 6/1993 | Elmore | E03F 5/0408 137/362 |
| 9,307,869 | B2 | 4/2016 | Dejesus et al. | |
| 9,731,441 | B2 | 8/2017 | Dejesus et al. | |
| 9,968,965 | B2 | 5/2018 | Iwamoto et al. | |
| 2007/0130685 | A1 * | 6/2007 | Huang | A47K 3/40 4/613 |
| 2008/0229494 | A1 * | 9/2008 | DeGooyer | E03F 5/0409 4/695 |
| 2014/0260031 | A1 | 9/2014 | Salazar et al. | |
| 2016/0059474 | A1 | 3/2016 | Singstad et al. | |
| 2019/0208965 | A1 * | 7/2019 | Gerhard | C23D 5/06 |
| 2020/0017976 | A1 * | 1/2020 | Gerhard | C23D 5/04 |

FOREIGN PATENT DOCUMENTS

JP 2002-220907 A 8/2002

* cited by examiner

*Primary Examiner* — Huyen D Le
(74) *Attorney, Agent, or Firm* — Workman Nydegger

(57) ABSTRACT

A plastic component for use in a tiled wet environment can include a base structure comprising a first polymer material, and an integrated bonding interface formed on the base structure. The integrated bonding interface includes a second polymer material welded to or fused with the first polymer material of the base structure at a boundary area. A plurality of aggregate particles partially embedded in a mortar facing surface of the second polymer material to form a three-dimensional surface adapted for capturing or locking mortar material in one or more spaces on the integrated bonding interface between the aggregate particles.

25 Claims, 3 Drawing Sheets

PLASTIC COMPONENTS FOR INSTALLATION IN TILED WET ENVIRONMENTS

TECHNICAL FIELD

The disclosure relates to a plastic component for installation in tiled wet environments.

BACKGROUND

Changing consumer preferences, designer influences, and in some cases the unavailability of craftsmen skilled in conventional installation methods have driven changes in the way tiled showers and other tiled wet environments are constructed. In particular, the trend points toward simplified wet environment installation methods and systems.

To facilitate these trends, integrated systems have been developed that use lighter materials, and that can be installed using quicker, simplified methods. In some cases, these systems are formed over a substrate with a moisture barrier such as a waterproof liner, shower pan, or other water impermeable surface to prevent water from leaking from the wet area. Generally, one or more plastic components such as drain fixtures, shower curbs, and shower niches are set in mortar and bonded to the moisture barrier. Decorative tiles are then set in the mortar over the moisture barrier and over or around the plastic components to form the tiled wet area. However, these tiled wet environments are known to leak for a variety of reasons.

One reason for wet area leaks is that mortars do not bond well to plastics. For example, channels can form or be present at the boundary between the mortar material and the plastic component. Other leaks occur from insufficient bonding between the plastic material and the plastic component that destabilizes the plastic component within the tiles. Regardless of how the leaks are born, significant damage can occur to the structure of the edifice as a result of the water leaks. Such damage can be costly and time consuming to correct.

Some attempts have been made to include fabrics on the plastic component for improved bonding performance. However, such attempts have generated products that are still susceptible to water leaks because the fabrics eventually break down and delaminate, creating pathways for water to escape. In addition, if there is any movement over time in the edifice due to an earthquake, settling, or other event, the expanding or contracting of the edifice can create movement in the tiled wet environment, which, in turn, can lead to separation between the layers of the fabric, creating pathways for water to leak from the tiled wet environment. Other attempts have been made to apply a coating to the plastic component for improved bonding performance. These attempts, however, have also been unsuccessful because the coating eventually rubs off or separates from the plastic component, increasing the likelihood of leaks and costly damage.

Accordingly, there is a need for plastic components that incorporate certain design improvements over other plastic components for improved bonding with mortar materials in a tiled wet environment.

SUMMARY

Embodiments of the present disclosure advantageously provide plastic components with an integrated bonding interface for improved bonding with mortar materials in a tiled wet environment. Moreover, these plastic component embodiments can be configured as various components commonly used in tiled wet environments (e.g., showers and bathrooms), including, but not limited to, configurations of floor drains, shower niches, shower curbs, drain covers, linear floor drains, drain bodies, drain risers, or any other suitable component.

According to an embodiment, a plastic component for use in a tiled wet environment comprises a base structure comprising a first polymer material and an integrated bonding interface. The integrated bonding interface can include a second polymer material welded to or fused with the first polymer material at a boundary area between the base structure and the integrated bonding interface. More particularly, molecular bonds can be formed between the first polymer material and the second polymer material in the boundary area such that the integrated bonding interface is bonded and sealed to the base structure.

In an embodiment, the crystallinity of the second polymer material can be different than the crystallinity of the first polymer material. For instance, the second polymer material can be formed independently from the first polymer material such that the second polymer material has a different crystallinity than the first polymer material. The integrated bonding interface can thus be easily formed on the plastic component without modification and/or interference with the molding of the base structure or plastic component, beneficially simplifying production of the plastic component with the integrated bonding interface.

This molecular bonding between the first and second polymer materials beneficially prevents the integrated bonding interface from separating from the base structure, which, in turn, reduces the likelihood of the formation of pathways for water to pass or escape between the base structure and the integrated bonding interface. It also is less prone to separation and failure due to movement events such as earthquakes and settling. Further, the integrated bonding interface is fully submersible in water with less risk of degradation of the integrated bonding interface because the molecular bonding between the first and second polymer materials at or near the boundary area is resilient or substantially resilient to breakdown from water. This is beneficial because prior art drain components with surface coatings or fabric faces are known to breakdown over time and/or separate when repeatedly or constantly submersed in water.

Because the polymer materials of the base structure and the integrated bonding interface are fused together at the boundary area via the molecular bonding, the boundary area can also be waterproof, preventing or reducing the likelihood of water getting between the base structure and the integrated bonding interface. For example, the integrated bonding interface prevents water from weeping through the integrated bonding interface and/or through the boundary area between the base structure and the integrated bonding interface.

The integrated bonding interface also can include a plurality of aggregate particles dispersed and partially embedded in a mortar facing surface of the second polymer material of the integrated bonding interface to form a three-dimensional surface. The three-dimensional surface is adapted for capturing or locking mortar material in one or more spaces between the particles, which, in turn, helps physically bond the mortar material to the plastic component.

BRIEF DESCRIPTION OF THE DRAWINGS

These and other features, aspects, and advantages of the present disclosure will become better understood regarding the following description, appended claims, and accompanying drawings.

Figure 1:
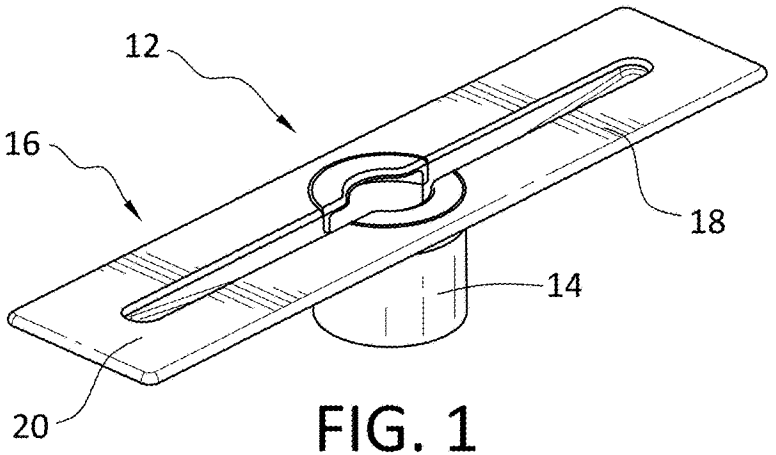
FIG. 1 shows an upper perspective view of a plastic component including a bonding interface according to an embodiment.

The drawing figures are not necessarily drawn to scale, but instead are drawn to provide a better understanding of the components, and are not intended to be limiting in scope, but to provide exemplary illustrations. The figures illustrate exemplary configurations of drain systems, and in no way limit the structures or configurations of a drain system and components according to the present disclosure.

DETAILED DESCRIPTION OF VARIOUS EMBODIMENTS

A better understanding of different embodiments of the disclosure may be had from the following description read with the accompanying drawings in which like reference characters refer to like elements.

While the disclosure is susceptible to various modifications and alternative constructions, certain illustrative embodiments are in the drawings and are described below. It should be understood, however, there is no intention to limit the disclosure to the specific embodiments disclosed, but on the contrary, the intention covers all modifications, alternative constructions, combinations, and equivalents falling within the spirit and scope of the disclosure.

It will be understood that unless a term is expressly defined in this application to possess a described meaning, there is no intent to limit the meaning of such term, either expressly or indirectly, beyond its plain or ordinary meaning.

Figure 2:
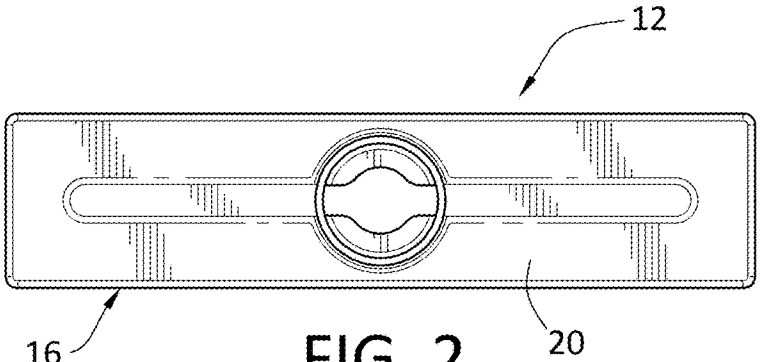
FIG. 2 shows a bottom view of the plastic component of FIG. 1.

Embodiments of the present disclosure advantageously provide plastic components with an integrated bonding interface for improved bonding with mortar materials in a tiled wet environment. Moreover, these plastic component embodiments can be configured as various components commonly used in tiled wet environments (e.g., showers and bathrooms), including, but not limited to, configurations of floor drains, shower niches, shower curbs, drain covers, linear floor drains, drain bodies, drain risers, or any other suitable component. For example, embodiments of the plastic component can be configured as a drain body installable in a tiled floor, as shown in FIGS. 1 and 2. An exemplary drain body 12 includes a lower portion 14 defining an outlet and configured to mate with a plumbing system or a drain pipe, and an upper portion 16 having an elongate configuration defining an opening and a flange 18 extending around the opening. The flange 18 can be a bonding flange sized and configured to be pressed against thin set mortar on an underlying support structure and optionally to provide an adhering or bonding surface for bonding the drain body 12 to a moisture barrier and/or thinset mortar.

As shown in FIGS. 1 and 2, upper and lower surfaces of the upper portion 16 include an integrated bonding interface 20. As described in more detail below, the integrated bonding interface 20 is configured for easy creation on different kinds of profiles on the drain body 12, improving the overall production and bonding performance of the drain body 12. For instance, the integrated bonding interface 20 can be formed on the top, underside, and/or side surfaces of the upper portion 16. Optionally, the integrated bonding interface 20 can be formed on sidewalls within openings and cavities.

In the illustrated embodiment, the integrated bonding interface 20 on the underside of the flange 18 is configured to improve bonding between the underside of the flange 18 and a thinset mortar material, attaching and supporting the drain body 12 on a subfloor or substrate. The integrated bonding interface 20 on the upper surface of the drain body 12 is configured to improve bonding between the upper surface of the drain body 12 and thinset mortar in a surface waterproofing installation of a tile floor. For instance, the drain body 12 can be installed in a subfloor with one or more waterproof panels around the drain body 12. A thinset mortar material can then be applied to at least a portion of the upper surface of the flange 18, and a moisture barrier can be bonded to the flange 18 and at least part of the upper surface of the waterproof panels surrounding the drain body 12. An upper drain component can then be installed in the drain body 12 and tiles can be installed around the upper drain component on the moisture barrier using thinset mortar material and grout material.

As noted above, the integrated bonding interface 20 of the drain body 12 provides a three-dimensional surface that is sealed and bonded to the drain body 12 so as to improve bonding with the mortar materials in the tiled wet floor and to reduce the likelihood of water leaks via the boundary between the integrated bonding interface 20 and the drain body 12. It will be appreciated that the drain body 12 can be formed of any suitable plastic material such as Acrylonitrile butadiene styrene (ABS) or Poly Vinyl Chloride (PVC). While the drain body 12 is described with an upper rectangular portion with a circular lower portion, it will be appreciated that the drain body 12 can have any suitable shape and/or configuration.

Figure 3:
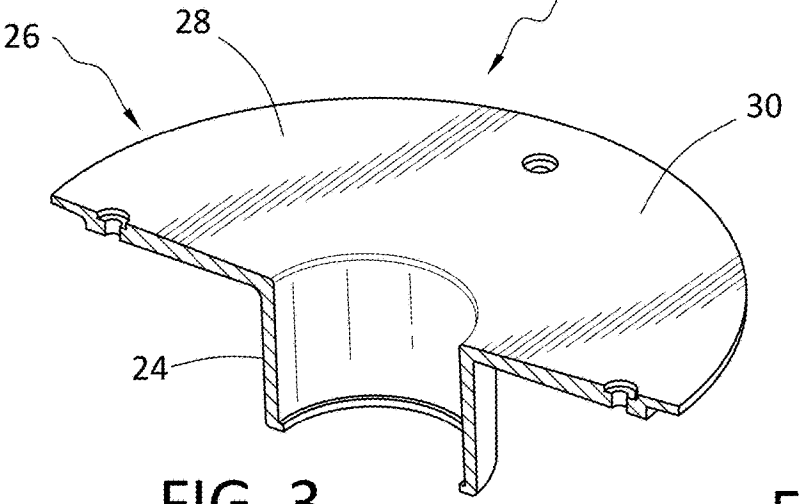
FIG. 3 shows a cutaway upper perspective view of a plastic component including a bonding interface according to another embodiment.

Embodiments of the plastic component for installation in a tiled wet environment can also be implemented as a drain body having a circular configuration, as shown in FIG. 3. An exemplary drain body 22 can include a lower portion 24 defining an outlet and configured to mate with a plumbing system or a drainpipe, and an upper portion 26 having a circular configuration defining an inlet and a flange 28 surrounding the inlet. At least an upper surface of the flange 28 includes an integrated bonding interface 30 like in the previous embodiment. Optionally, the sides and underside of the flange 28 can also include the integrated bonding interface 30. Moreover, because of the ease of creating the integrated bonding interface 30, the integrated bonding interface 30 can be selectively or strategically located on different surfaces on the drain body 22. For instance, a transition between the flange 28 and the opening can define a curvature. The integrated bonding interface 30 can be located along at least a portion of the curvature.

Like discussed above, the integrated bonding interface 30 provides a three-dimensional surface that is sealed and bonded to a base material of the drain body 22 so as to improve bonding with the mortar materials in a tiled wet floor and to reduce the likelihood of water leaks via the boundary between the integrated bonding interface 30 and the base material. It will be appreciated that the drain body 22 can be formed of any suitable plastic material such as ABS or PVC.

Figure 4:
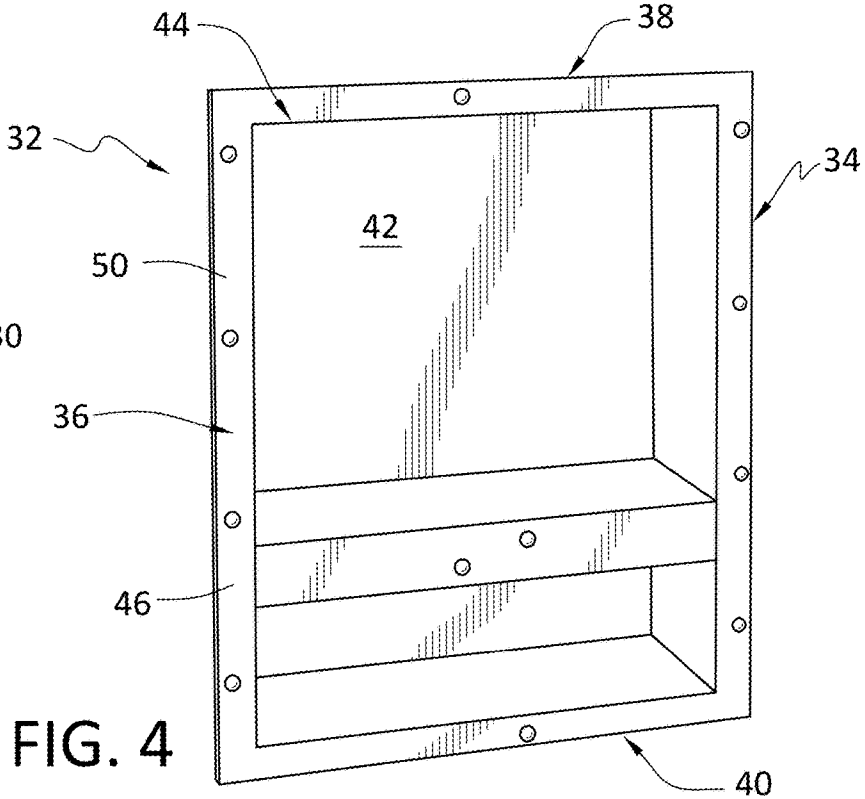
FIG. 4 shows a perspective view of a plastic component including a bonding interface according to another embodiment.

By way of another example, embodiments of the plastic component for installation in a tiled wet environment can be configured as a shower niche as seen in FIG. 4. An exemplary shower niche 32 can include a generally rectangular housing 34 having a pair of spaced apart sides 36, a top 38 and a bottom 40. The housing sides 36, the top 38, and the bottom 40 form a cavity 42 having an open front 44 dimensioned to receive bathing products. A mounting flange 46 extends outwardly from the open front of the housing cavity 42 around the entire periphery of the housing 34. When the housing 34 is installed within a shower, this outwardly extending flange 46 can abut against the shower wall. The shower niche 32 is dimensioned to be recessed between two adjacent framing members so that at least a portion of the flange 46 abuts against the shower wall and can be tiled over.

The shower niche 32 can be made of ABS, PVC, or another plastic material and at least the flange 46 can include an integrated bonded interface 50 similar to the interfaces described above. The integrated bonded interface 50 provides a three-dimensional surface that is sealed and bonded to a base material of the shower niche 32 so as to improve bonding with the mortar materials in the tiled shower wall and to reduce the likelihood of water leaks via the boundary between the integrated bonding interface 50 and the base material. Optionally, the housing cavity 42 can include the integrated bonded interface 50 so that tiles can be set in thinset mortar securely bonded to the integrated bonding interface 50 of the housing cavity 42.

Figure 5:
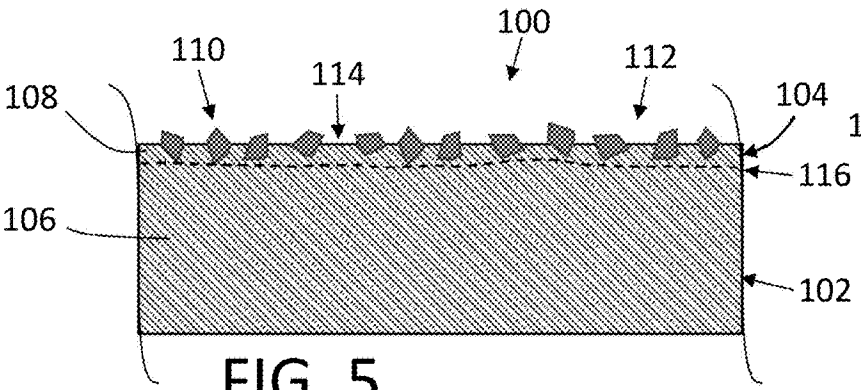
FIG. 5 shows a cross-section view of a plastic component including a bonding interface according to an embodiment.
Figure 6:
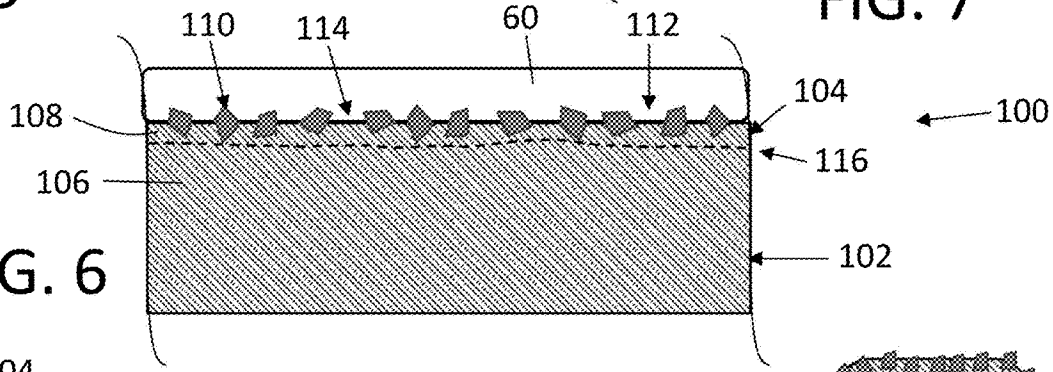
FIG. 6 shows a cross-section view of a plastic component including a bonding interface according to another embodiment.

Exemplary cross sections of plastic component embodiments will now be described in additional detail. FIGS. 5 and 6 illustrate a cross section of a plastic component 100 according to an embodiment. It will be appreciated that the plastic component 100 can be any plastic component adapted for installation in a tiled wet environment. For instance, the plastic component 100 can be a square floor drain, a circular floor drain, a linear floor drain, a shower niche, a soap holder, a drain cover, a drain body, a drain riser, or any other suitable plastic component.

The plastic component 100 comprises a base structure 102 and an integrated bonding interface 104. The base structure 102 can comprise a first polymer material 106 and the integrated bonding interface 104 comprising a second polymer material 108 fused with the first polymer material 106 of the base structure 102. Preferably, the first polymer material 106 and the second polymer material 108 are the same. For instance, the first polymer material 106 and the second polymer material 108 can comprise ABS. In other embodiments, the first polymer material 106 and the second polymer material 108 can be different.

The second polymer material 108 can have a different crystallinity than the first polymer material 106. Crystallinity as used herein refers to the degree as to which there are regions where the polymer chains are aligned with one another. In an embodiment, the second polymer material 108 can have a different crystallinity than the first polymer material 106 because the second polymer material 108 can be processed or formed differently than the first polymer material 106. For instance, the base structure 102 can comprise a plastic molded part and the integrated bonding interface 104 can be formed independent of and/or subsequent to formation of the base structure 102. The integrated bonding interface 104 thus beneficially does not interfere with, complicate, or slow down the process of forming the base structure 102.

A plurality of aggregate particles 110 are dispersed and partially embedded in a mortar facing surface 112 of the second polymer material 108 of the integrated bonding interface 104 to form a three-dimensional surface for capturing or locking mortar material 60 in one or more spaces 114 defined between the aggregate particles 110, which, in turn, helps physically bond the mortar material 108 to the plastic component 100. The plurality of aggregate particles may be arranged such that individual particles thereof project from the mortar facing surface 112 of the second polymer material 108 of the integrated bonding interface 104. For example, 25%, or at least 25%, of a surface area of the individual particles may extend outside of the second polymer material 108, or 30%, at least 30%, 50%, or at least 50%.

The first polymer material 106 of the base structure 102 is welded to or fused with the second polymer material 108 of the integrated bonding interface 104 at a boundary area 116. More particularly, molecular bonds are formed between the first polymer material 106 and the second polymer material 108 in the boundary area 116 such that the integrated bonding interface 104 is bonded and sealed to the base structure 102. This molecular bonding between the first and second polymer materials 106, 108 beneficially prevents the integrated bonding interface 104 from separating from the base structure 102, which, in turn, reduces the likelihood of the formation of pathways for water to pass or escape between the base structure 102 and the integrated bonding interface 104. It also is less prone to separation and failure due to movement events than prior art drain systems. Further, the integrated bonding interface 104 is fully submersible in water with a reduced risk of degradation of the integrated bonding interface 104 because the molecular bonding between the first and second polymer materials 106, 108 at or near the boundary area is resilient or substantially resilient to breakdown from water. This is beneficial because prior art drain components with surface coatings or fabric faces are known to breakdown over time and/or separate when repeatedly or constantly submersed in water.

Because the base structure 102 and the integrated bonding interface 104 are also sealed together at the boundary area 116 via the molecular bonding, the boundary area 116 is also waterproof, preventing or reducing the likelihood of water getting between the base structure 102 and the integrated bonding interface 104. For example, the integrated bonding interface 104 prevents water from weeping through the integrated bonding interface 104 and/or through the boundary area 116 between the base structure 102 and the integrated bonding interface.

As illustrated above, the plastic component 100 thus provides improved bonding with mortar materials in a tiled wet environment. It is also more durable, more waterproof, and less prone to failure due to movement events and/or prolonged exposure to water than prior art plastic components with multilayered fabrics or coatings.

According to an embodiment, the aggregate particles 110 can comprise aluminum oxide, silica sand, blast grit, metallic grit, ceramic grit, shot, combinations thereof, or any other suitable material to form the three-dimensional surface of the integrated bonding interface 104. The aggregate particles 110 can be angular, rounded, irregularly shaped, or combinations thereof. The aggregate particles 110 can comprise uniform or substantially uniform-size particles. In an embodiment, the aggregate particles 110 can have an average grit size between about 100 and about 300, between about 100 and about 200, or between about 100 and about 150. In other embodiments, the aggregate particles 110 can be uniformly shaped or substantially uniformly shaped particles. In an embodiment, the aggregate particles 110 can be uniformly distributed. In other embodiments, the aggregate particles 110 can include a varying distribution of particle sizes and/or shapes.

Figure 7:
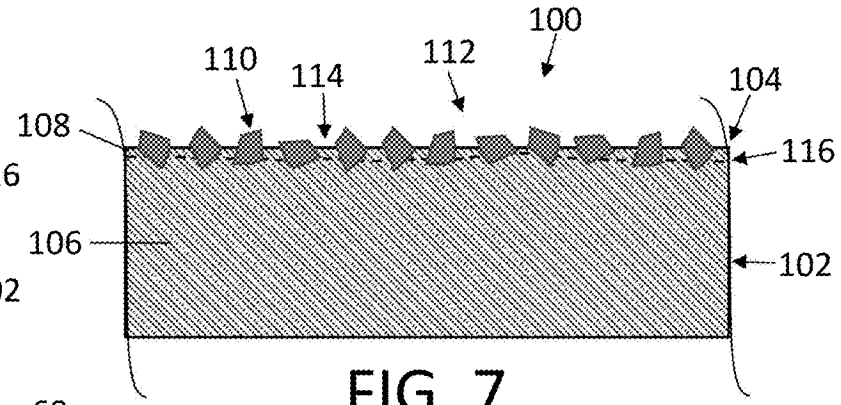
FIG. 7 shows a cross-section view of a plastic component including a bonding interface according to another embodiment.

In the illustrated embodiment, the aggregate particles 110 extend to a depth that terminates in the second polymer material 108 short of the boundary area 116. Optionally, the aggregate particles 110 can be configured to extend to a depth through the second polymer material 108, the boundary area 116, and into the first polymer material 106 of the base structure 102 as shown in FIG. 7. This arrangement can help fix the aggregate particles 110 to the plastic component 100.

The aggregate particles 110 may substantially cover the mortar facing surface 112 of the second polymer material 108 of the integrated bonding interface 104. In an embodiment, the aggregate particles may cover at least 98% of a surface area of the mortar facing surface 112, at least 95%, at least 90%, at least 80%, or at least 60%. In this manner the aggregate particles 110 provide a surface capable of improved bonding with mortar materials while preventing the passage of moisture that may occur where mortar is insufficiently bonded to a polymer material, as may occur in conventional plastic components.

Figure 8:
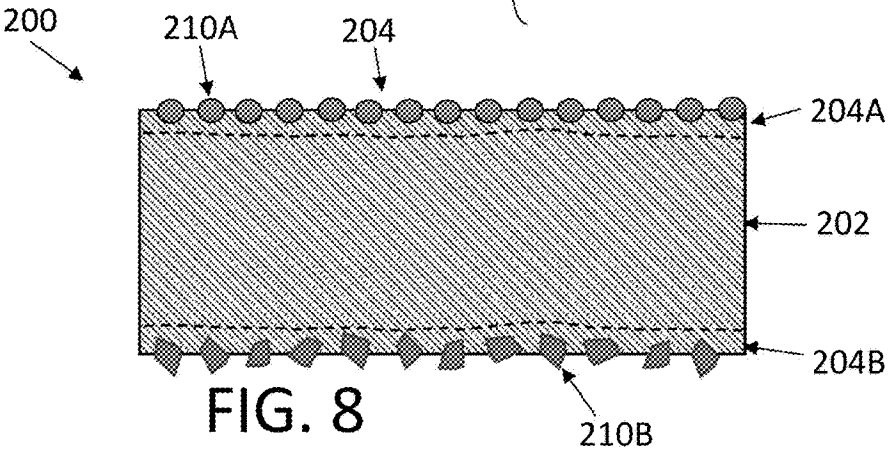
FIG. 8 shows a cross-section view of a plastic component including a bonding interface according to another embodiment.

As described in more detail below, the integrated bonding interface can be easily created on almost any surface of a plastic component. FIG. 8 illustrates a plastic component 200 according to an embodiment having a base structure 202 and an integrated bonding interface 204 comprising a first integrated bonding interface 204A at an upper surface of the base structure 202, and a second integrated bonding interface 204B at a lower surface or underside of the base structure. The integrated bonding interfaces 204A, 204B can be similar to the integrated bonding interfaces described above. In an embodiment, the first and second integrated bonding interfaces 204A, 204B can be the same or similar. In other embodiments, the first and second integrated bonding interfaces 204A, 204B can be configured differently from one another. For instance, the first integrated bonding interface 204A could have a plurality of aggregate particles 210A sized and configured to bond with a first type of mortar material, and the second integrated bonding interface 204B could have a plurality of aggregate particles 210B sized and configured to bond with a second type of mortar material underlying the plastic component 200.

Figure 9:
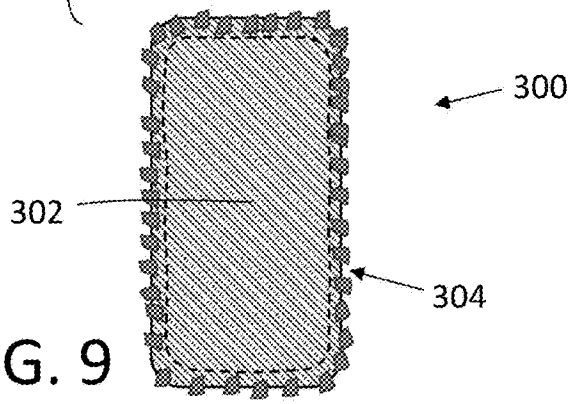
FIG. 9 shows a cross-section view of a plastic component including a bonding interface according to another embodiment.

FIG. 9 illustrates a plastic component 300 according to yet another embodiment having a base structure 302 and an integrated bonding interface 304 located along an entirety of the outer surface of the plastic component 300. As noted above, the nature of the integrated bonding interface 304 allows it to be formed on almost any surface of the plastic component 300, without complicating manufacturing of the base structure 302.

Figure 10:
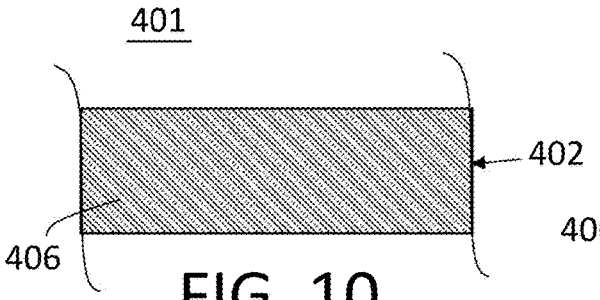
FIGS. 10-15 illustrate production of a plastic component including a bonding interface according to an embodiment.

FIGS. 10-15 illustrate a method of producing or manufacturing the plastic component 400 (shown in FIG. 15) for installation in a tiled wet environment according to an embodiment. A step 401 can include providing a base structure 402 as shown in FIG. 10. The base structure 402 can comprise a molded plastic part. For instance, the base structure 402 can comprise a molded square floor drain, a molded circular floor drain, a molded linear floor drain, a molded shower niche, a molded soap holder, a molded drain cover, a molded drain body, a molded drain riser, a molded tile frame, or any other suitable molded plastic part. The base structure 402 can have any suitable shape. The step 401 can include molding the base structure or using an existing molded plastic part of the base structure 402. The base structure 402 can include a first polymer material 406. The first polymer material 406 can comprise ABS plastic material, PVC plastic material, CPVC plastic material, or any other suitable polymer material.

Figure 11:
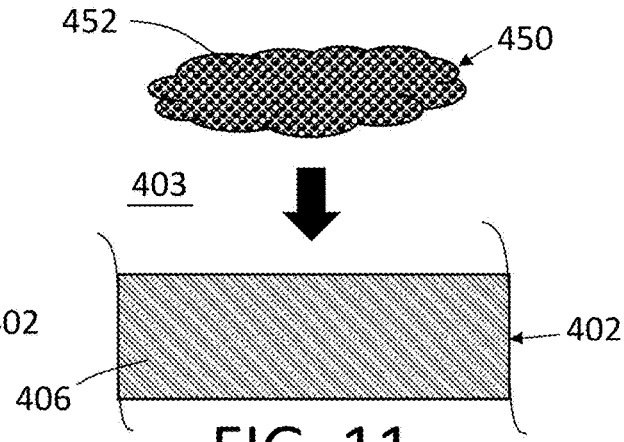
Figure 12:
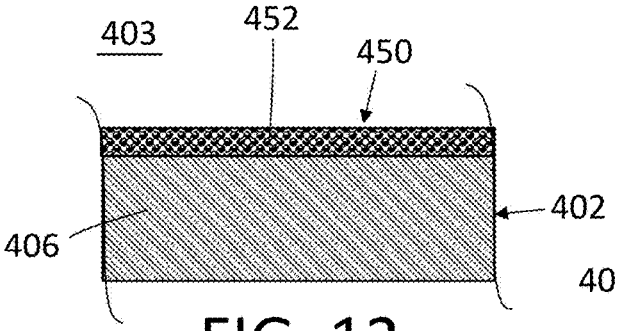

A step 403 can include applying a formulation 450 to the base structure 402 as shown in FIGS. 11 and 12. The formulation 450 can comprise a polymer resin or a plurality of polymer particles 452 in a carrier. In an embodiment, the carrier can comprise a solvent solution and the polymer particles 452 can be suspended in the solvent solution. The polymer particles 452 can comprise ABS particles, PVC particles, CPVC particles, or any other suitable type of polymer particles. Preferably, the polymer particles 452 are the same polymer as the first polymer material 406. The solvent solution can comprise tetrahydrofuran, Acetone, Methyl Ethyl Ketone, 2-Butanone, Dimethyl Carbonate, and/or any other suitable solvent solution. While the carrier is described comprising a solvent solution, in other embodiments, the carrier may comprise a catalyzed coating, an epoxy, an emulsion or any other suitable carrier for the polymer resin or polymer particles 452. Step 403 can comprise formulating the formulation 450 for different applications.

In an embodiment, the formulation 450 may be configured to harden and/or polymerize at a controlled rate. For instance, the formulation 450 may include an inhibitor and/or a retarder for slowing and/or preventing polymerization under certain conditions. Such an inhibitor may include a reversible terminating agent, stable free radical, or the like that prevents or slows completion of a polymerization reaction, for example at a low temperature, as would be understood by one skilled in the art from the present disclosure.

Step 403 can include spraying the formulation 450 onto the base structure 402. Step 403 can include immersing or dipping the base structure 402 in the formulation 450. Step 403 can include painting the brushing the formulation 450 onto the base structure 402. Step 403 can include controlling the viscosity of the formulation to facilitate application of the 450 on the base structure 402. For instance, the ratio between the solvent solution and polymer particles 452 can be selected to vary the viscosity of the formulation 450 to facilitate application of the formulation 450 on the base structure 402. Optionally, step 403 can include varying the temperature of the formulation 450 to control flashing of the solvent solution and/or a rate of polymerization of the polymer particles 452. As discussed below, this beneficially provides more time for the application of a plurality of aggregate particles before the solvent solution vaporizes and before polymerization of the polymer particles 452 causes the formulation 450 to harden or seal. Step 403 can include the solvent solution of the formulation 450 softening and/or dissolving the first polymer material 406 of the base structure 402, which, in turn, makes polymer molecules or chains from the first polymer material 406 available for molecular bonding or cross-linking with the polymer particles 452. When this occurs, the polymer molecules or polymer chains are free to move in the solvent solution and can mingle with other polymer molecules or polymer chains.

Figure 13:
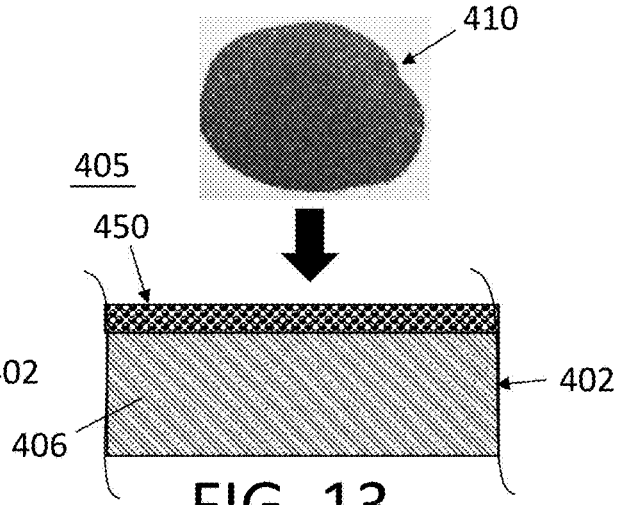
Figure 14:
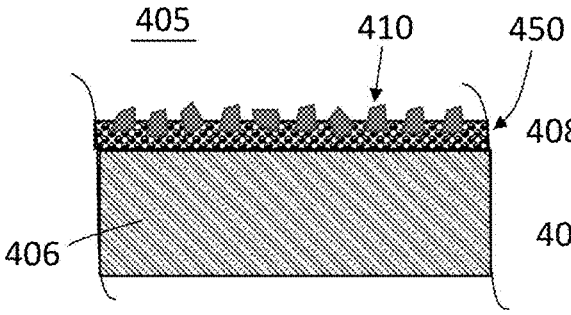

A step 405 can include applying a plurality of aggregate particles 410 to the formulation 450. Step 405 can include applying the aggregate particles 410 after the formulation 450 has been applied to the base structure 402 as shown in FIGS. 13 and 14. The aggregate particles 410 can comprise aluminum oxide, silica sand, blast grit, metallic grit, ceramic grit, shot, combinations thereof, or any other suitable material to form a three-dimensional surface. The aggregate particles 410 can be angular, rounded, irregularly shaped, or combinations thereof. The aggregate particles 410 can comprise uniform or substantially uniform-size particles. In other embodiments, the aggregate particles 410 can be uniformly shaped or substantially uniformly shaped. In an embodiment, the aggregate particles 410 can be uniformly distributed. In other embodiments, the aggregate particles 410 can include a varying distribution of particle sizes and/or shapes.

Step 405 can include applying the aggregate particles 410 to the formulation 450 while the formulation 450 is wet or in a liquid state. For instance, step 405 can include varying the temperature of the formulation 450 to control flashing of the solvent solution, which, in turn, allows for the application of the plurality of aggregate particles 410 before the formulation 450 hardens. In an embodiment, the formulation 450 may be applied to the base structure 402 at a temperature at or below 5° C., at or below 2° C., or at or below 0° C., and the aggregate particles 410 may be applied to the formulation 450 while the formulation is at or below 5° C., at or below 2° C., or at or below 0° C. In like manner, the aggregate particles 450 and/or the base structure 402 may be maintained at or below 5° C., at or below 2° C., or at or below 0° C. during steps 403 and/or 405.

In a further embodiment, the formulation 450 may be applied to the formulation 450 during an induction period of a chemical reaction, for example an induction period caused by an inhibitor or retarder at predetermined temperatures or during a period of the reaction controlled by a limited availability of reactants.

One or both of steps 403 and 405 may be performed in a temperature- and/or atmosphere-controlled environment in order to control a polymerization rate of the formulation 450. For instance, application of the formulation 450 and/or application of the aggregate particles 410 may be performed in a freezer.

Step 405 can include applying the aggregate particles 410 to the formulation 450 while the formulation 450 is in a liquid state and the aggregate particles 410 are dry. Step 405 can include applying the aggregate particles 410 to the formulation 450 such that the aggregate particles 410 are partially embedded in the formulation 450. Step 405 can include controlling the viscosity of the formulation 450 to control the embedded depth of the aggregate particles 410 in the formulation 450.

Step 407 can include hardening the formulation 450 to form an integrated bonding interface 404 on the base structure 402 through cross-linking and/or polymerization of the polymer particles 452 of the formulation 450. Like other embodiments, the integrated bonding interface 404 can include a second polymer material 408 comprising the polymer particles 452 molecularly bonded to each other and to the first polymer material 406 of the base structure 402, and the aggregate particles 410 partially embedded in a mortar facing surface 412 of the second polymer material 408. The first polymer material 406 and the second polymer material 408 are preferably the same polymer material. For instance, both can be ABS plastic material. In other embodiments, both can be PVC plastic material.

Step 407 can include curing the formulation 450 with heat or ultraviolet light. For instance, where the formulation 450 comprises an epoxy it may be cured with heat to make the integrated bonding interface 404 more heat and/or chemical resistant. Step 407 can include varying a temperature of the formulation 450 such that the solvent solution flashes and the second polymer material 408 hardens to form the plastic component 400 with the integrated bonding interface 404.

Step 407 can include a waiting a period of time for the formulation to harden. For instance, step 407 can include waiting a period of time for at least part or substantially all of the solvent solution to move out of the formulation 450 into the environment, which, in turn, causes the polymer molecules or chains to lose their mobility and forms the second polymer material 408 having a hardened configuration bonded to and/or entangled with the polymer molecules or chains of the first polymer material 406. Step 407 can include using additives to harden the formulation and form the integrated bonding interface 404.

It will be appreciated that the second polymer material 408 can have a different crystallinity than the first polymer material 406. For instance, the crystallinity of the second polymer material 408 can be different than the crystallinity of the first polymer material 406 because the second polymer material 408 is processed or formed independently from the first polymer material 406 of the base structure 402.

In a varying embodiments, steps 403 and 405 may be performed in reverse order. In such an embodiment, an amount or location of the formulation 450 applied to the aggregate particles 452 on the base structure 402 may be reduced or otherwise controlled, such that the formulation 450 polymerizes or hardens in such a way as to preserve exposure of the aggregate particles 452 as the mortar facing surface 112 and to result in contact between the first polymer material and the second polymer material. For this purpose, a chemical reaction or polymerization of the formulation 450 may be controlled by temperature, an inhibitor, a retarder or the like until the formulation 450 settles about the aggregate particles 452 in a preferred manner.

It will be appreciated that one or more of the foregoing steps can be omitted or combined with other steps. Further, as noted above, the carrier of the formulation 450 can comprise catalyzed coatings, emulsions, epoxies, solvent solutions, and/or any other suitable carrier for the polymer resin or particles. The integrated bonding interface 404 can thus be easily formed on the plastic component 400 without modification and/or interference with the molding of the base structure 402 or plastic component 400, beneficially simplifying production of the plastic component embodiments.

Figure 15:
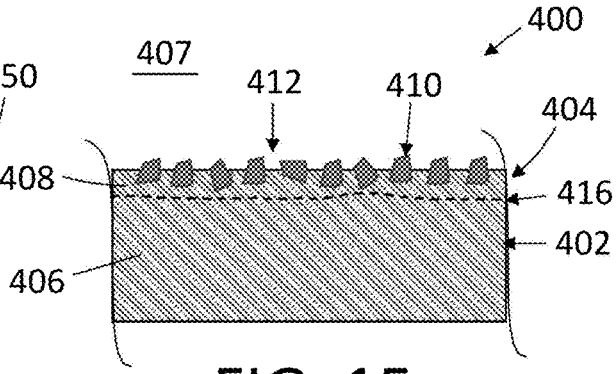

As seen in FIG. 15, the aggregate particles 410 partially embedded in the second polymer material 408 form a three-dimensional surface for improved bonding with mortar and other materials. In addition, the molecular linking or bonding between the first and second polymer materials 406, 408 beneficially prevents the integrated bonding interface 404 from separating from the base structure 402, which, in turn, reduces the likelihood of the formation of pathways for water to pass or escape between the base structure 402 and the integrated bonding interface 404. It also is less prone to separation and failure due to movement events than prior art drain systems. Further, the integrated bonding interface 404 is fully submersible in water without the risk of degradation of the integrated bonding interface 404 because the molecular bonding between the first and second polymer materials 406, 408 makes the integrated bonding interface 404 integral to the base structure 402. This is beneficial because prior art drain components with surface coatings or fabric faces are known to breakdown over time and/or separate when repeatedly or constantly submersed in water.

In addition, because the base structure 402 and the integrated bonding interface 404 are sealed together at the boundary area 416 via the molecular bonding, the boundary area 416 is also waterproof, preventing or reducing the likelihood of water getting between the base structure 402 and the integrated bonding interface 404. For example, the integrated bonding interface 404 prevents water from weeping through the integrated bonding interface 404 and/or through the boundary area 416 between the base structure 402 and the integrated bonding interface.

As illustrated above, the plastic component 400 thus provides improved bonding with mortar and other materials in a tiled wet environment. It is also more durable, more waterproof, and less prone to failure due to movement events and/or prolonged exposure to water than prior art plastic components with multilayered fabrics or coatings.

The various aspects and embodiments disclosed herein are for purposes of illustration and are not intended to be limiting. For instance, while the plastic components are described for use in tiled wet environments, in other embodiments, the plastic components can be configured for use in any environment where the plastic component is adapted to bond with a cementitious material and is exposed to water. Additionally, the words "including," "having," and variants thereof (e.g., "includes" and "has") as used herein, including the claims, shall be open ended and have the same meaning as the word "comprising" and variants thereof (e.g., "comprise" and "comprises").

The invention claimed is:

1. A plumbing component for use in a tiled wet environment comprises:
   - a base structure comprising a first polymer material; and
   - an integrated bonding interface formed on the base structure, the integrated bonding interface comprising:
     - a second polymer material welded to or fused with the first polymer material at a boundary area between the base structure and the integrated bonding interface; and
     - a plurality of aggregate particles partially embedded in a mortar facing surface of the second polymer material to form a three-dimensional surface adapted for capturing or locking mortar material in one or more spaces on the integrated bonding interface between the aggregate particles.

2. The plumbing component of claim 1, wherein a plurality of molecular bonds are formed between the first polymer material and the second polymer material in the boundary area such that the integrated bonding interface is bonded and sealed to the base structure.

3. The plumbing component of claim 1, wherein the second polymer material is formed independently from the first polymer material such that the second polymer material has a different crystallinity than the first polymer material.

4. The plumbing component of claim 1, wherein the second polymer material is a same polymer as the first polymer material.

5. The plumbing component of claim 4, wherein the same polymer comprises an ABS material.

6. The plumbing component of claim 4, wherein the same polymer comprises a PVC material.

7. The plumbing component of claim 1, wherein the plumbing component comprises a drain body, a shower niche, a drain riser or a tile frame.

8. The plumbing component of claim 1, wherein at least 90% of a surface area of the mortar facing surface comprises the plurality of aggregate particles.

9. The plumbing component of claim 1, wherein at least 95% of a surface area of the mortar facing surface comprises the plurality of aggregate particles.

10. The plumbing component of claim 1, wherein at least 25% of a surface area of individual particles in the plurality of aggregate particles extends outside of the second polymer material.

11. The plumbing component of claim 1, wherein the integrated bonding interface is formed on an upper surface and a lower surface of the base structure.

12. The plumbing component of claim 11, wherein the integrated bonding interface is formed on a side surface of the base structure extending between the upper and lower surfaces.

13. The plumbing component of claim 1, wherein the integrated bonding interface is formed on a bonding flange of the plumbing component.

14. The plumbing component of claim 1, wherein the aggregate particles comprise aluminum oxide.

15. The plumbing component of claim 1, wherein the aggregate particles terminate above the boundary area.

16. The plumbing component of claim 1, wherein the aggregate particles terminate in the first polymer material.

17. A plumbing component for use in a tiled wet environment comprises:
   - a base structure comprising a first polymer material; and
   - an integrated bonding interface formed on the base structure, the integrated bonding interface comprising:
     - a second polymer material welded to or fused with the first polymer material at a boundary area via a plurality of molecular bonds formed between the first polymer material and the second polymer material in the boundary area such that the integrated bonding interface is bonded and sealed to the base structure, the second polymer material being a same polymer as the first polymer material; and
     - a plurality of aggregate particles partially embedded in a mortar facing surface of the second polymer material to form a three-dimensional surface adapted for capturing or locking mortar material in one or more spaces on the integrated bonding interface between the particles.

18. The plumbing component of claim 17, wherein the same polymer comprises an ABS plastic material.

19. A method for forming a plumbing component for use in a tiled wet environment, the method comprising:
   - providing a base structure comprising a first polymer material;
   - applying a second polymer solution to a surface of the base structure;
   - applying a plurality of aggregate particles to the second polymer solution; and hardening the second polymer solution into a second polymer material molecularly bonded to the first polymer material.

20. The method according to claim 19, wherein the second polymer solution is applied to the surface of the base structure at a temperature at or below 5° C.

21. A method of producing a plumbing component for use in a tiled wet environment, the method comprising:

providing a base structure comprising a first polymer material;

applying a formulation to the base structure, the formulation comprising a plurality of polymer particles in a carrier;

applying a plurality of aggregate particles to the formulation; and hardening the formulation to form an integrated bonding interface on the base structure, the integrated bonding interface comprising a second polymer material comprising the polymer particles molecularly bonded to each other and to the first polymer material of the base structure at a boundary area between the base structure and the integrated bonding interface, and the aggregate particles partially embedded in a mortar facing surface of the second polymer material to form a three-dimensional surface adapted for capturing or locking mortar material in one or more spaces on the integrated bonding interface between the aggregate particles.

22. The method of claim 21, wherein the second polymer material is a same polymer of the first polymer material.

23. The method of claim 21, wherein the base structure comprises a drain body including a bonding flange.

24. The method of claim 21, wherein the base structure comprises a shower niche.

25. The method of claim 21, wherein the base structure comprises a drain riser.

* * * * *